US008424159B2

(12) United States Patent
Nicolas Domingo et al.

(10) Patent No.: US 8,424,159 B2
(45) Date of Patent: Apr. 23, 2013

(54) DOOR RETAINING DEVICE

(75) Inventors: Joaquin Nicolas Domingo, Montgat (ES); Aitor Agell Merino, Les Franqueses del Valles (ES)

(73) Assignee: Flexngate Automotive Iberica, S.A., Les Franqueses del Valles (ES)

( * ) Notice: Subject to any disclaimer, the term of this patent is extended or adjusted under 35 U.S.C. 154(b) by 239 days.

(21) Appl. No.: 12/835,326

(22) Filed: Jul. 13, 2010

(65) Prior Publication Data

US 2011/0179599 A1 Jul. 28, 2011

(30) Foreign Application Priority Data

Jan. 22, 2010 (ES) ..... 201030079

(51) Int. Cl.
*E05F 5/06* (2006.01)

(52) U.S. Cl.
USPC ..... 16/85; 16/82; 16/86 C

(58) Field of Classification Search ..... 16/82, 85, 16/49, 50, 86 R, 86 A, 86 B, 86 C; 292/262, 292/DIG. 15; 296/146.11, 146.12
See application file for complete search history.

(56) References Cited

U.S. PATENT DOCUMENTS

| | | | | |
|---|---|---|---|---|
| 5,474,344 | A * | 12/1995 | Lee | 292/262 |
| 6,842,943 | B2 * | 1/2005 | Hoffmann et al. | 16/82 |
| 7,076,833 | B2 * | 7/2006 | Murayama et al. | 16/82 |
| 7,530,141 | B2 * | 5/2009 | Heinrichs et al. | 16/86 C |
| 7,793,387 | B2 * | 9/2010 | Clark | 16/86 C |
| 7,870,641 | B2 * | 1/2011 | Hoffmann et al. | 16/82 |
| 2006/0207057 | A1 * | 9/2006 | Migli | 16/85 |
| 2006/0207058 | A1 | 9/2006 | Heinrichs et al. | |
| 2008/0184525 | A1 | 8/2008 | Cruz et al. | |
| 2008/0209675 | A1 | 9/2008 | Sempert et al. | |
| 2010/0154163 | A1 * | 6/2010 | Hoffmann | 16/85 |

FOREIGN PATENT DOCUMENTS

| | | | |
|---|---|---|---|
| DE | 19745928 | A1 | 4/1999 |
| DE | 102007029707 | A1 | 1/2009 |
| EP | 1 588 006 | A1 | 10/2005 |
| WO | 2004/065736 | A1 | 8/2004 |
| WO | 2007/031073 | A2 | 3/2007 |
| WO | 2007/057332 | A1 | 5/2007 |

OTHER PUBLICATIONS

Spanish Search Report dated Feb. 11, 2013 issued in Spanish Application No. 201030079.

* cited by examiner

*Primary Examiner* — William L. Miller
(74) *Attorney, Agent, or Firm* — Sughrue Mion, PLLC

(57) ABSTRACT

A door retaining device having a housing and a retaining rod which traverses it, the device including a brake housed in the housing having a brake body stressed by a corresponding compression spring towards the retaining rod. The housing is formed by several parts assembled to one another, including a guide body molded in plastic for guiding the rod, provided with a through hole which is traversed by the rod and with at least one side hole in communication with the through hole; and a receptacle, detachably plugged to the side hole of the guide body, which houses and guides the movement of the brake body towards the retaining rod through the side hole, and in which the compression spring is supported to exert its thrusting action on the brake body.

17 Claims, 3 Drawing Sheets

DOOR RETAINING DEVICE

TECHNICAL FIELD OF THE INVENTION

The object of the invention is a door retaining device of those comprising a housing and a retaining rod which traverses it, the housing being intended to be firmly and the rod being intended to be pivotably fixed to a door of a vehicle and to the framework of said door, respectively, or vice versa. This type of device is provided with brake means housed in the housing which comprise at least one brake body stressed by a corresponding compression spring towards the retaining rod for the purpose of exerting by friction a resistance to the longitudinal movement of the rod in relation to the housing.

BACKGROUND OF THE INVENTION

Multiple variants of blocking devices for the door of an automobile, also known as retaining devices, are currently known.

From among the known variants, the invention belongs to the type of devices of those comprising a housing which is traversed by a retaining rod, the housing being provided with brake members which, tensioned by a compression spring, are thrust towards the retaining rod. The brake members are generally provided with a contact surface intended to be applied, under pressure, against a corresponding face of the retaining rod, which is provided throughout its length with a series of recesses, in correspondence with the contact surface of the brake members, in which the brake members are fitted to offer a resistance to the sliding of the retaining rod through the housing. The mentioned housing is intended to be firmly assembled to the frame of a door or to the door, whereas the rod is fixed pivotably and at one of its ends to the component of the door in which the housing is not fixed, such that the opening or closing movement of the door causes the sliding of the retaining rod through the housing. In those positions in which the brake members stressed by the respective compression springs fit in the recesses of the retaining rod, the door tends to remain stable in an intermediate opening or closing position.

The objective of patent document EP 1588006 is a device which can be manufactured in a more cost-effective manner. Unlike other previous devices such as that described in document U.S. Pat. No. 6,842,943, formed by a hollow housing molded in plastic, which houses the brake members, requiring metal sheets for the compression of the springs previously introduced in the housing, the device described in EP 1588006 is formed by a first housing half and a second housing half which can be attached to one another, each limiting only one section of the contour of the opening for the passage of the retaining rod, in each of which there is housed a corresponding brake member tensioned by a respective spring towards the retaining rod which is supported directly on the bottom of the corresponding housing half.

The previously described device has some drawbacks, relating to the amount of material necessary for the formation of the two halves of the housing and with the supplementary means necessary for the attachment between the two halves of the housing, consisting of rivets.

In fact, the housings comprise respective boreholes for their fixing to the frame of the door or to the door of the vehicle, but the housings must necessarily be provided with respective projections, moved to a side of the cavity for guiding the brake member, for the arrangement of the boreholes. In addition to the increase in material, the points for anchoring the device are not centered or coincide with the longitudinal plane of the device, along which the brake members move, which causes a torque during the operation of the device caused by the thrust exerted by the retaining rod, which can bring about the loosening of the attachment of the housings to the vehicle looses.

In addition, the operation of insertion and further fixing of the rivets, as well as the cost of these components necessary for the attachment of the two housing halves do not precisely favor a reduction in the manufacturing cost. Furthermore, the time required to disassemble the device, for example to substitute the compression springs, is significant and it is not possible to perform this operation without destroying the components irreversibly attached by rivets.

Although patent document WO 2007031073 describes a variant which solves the problem of the location of the points for anchoring the device, it does not eliminate the drawback associated with the attachment between the two housing halves.

Document WO 2007057332 describes an alternative solution but lacking interest, due to the fact that it incorporates a metal sheet to attach the two housing halves to one another. For the handling of the mentioned sheet, and especially for bending it and introducing it into grooves provided for such purpose in the housing halves, tools are necessary and the operation is too time consuming to considerably reduce costs. Furthermore, incorporating metal closures which must necessarily be protected against corrosion generally involves a cost increase in comparison with the use of plastic components.

In the designs pursuing a split case solution such as those previously described, the fixing plane between the two housing halves cannot be assured due to the manufacturing tolerances, which can lead to a situation in which the brake members, guided only by their corresponding housing halves, are not perfectly aligned, causing noises, torque losses and low stability in a defined rest position.

A more cost-effective device, which represents a significant reduction in the assembly time, and which at the same time solves the aforementioned drawbacks, is therefore an objective of the present invention.

DISCLOSURE OF THE INVENTION

The device according to the invention is of those comprising a housing and a retaining rod which traverses it, the housing being intended to be tightly and the rod being intended to be pivotably fixed to a door of a vehicle and to the framework of said door, respectively, or vice versa, the device furthermore comprising brake means housed in the housing which comprise at least one brake body stressed by a corresponding compression spring towards the retaining rod to exert by friction a resistance to the longitudinal movement of the rod in relation to the housing.

The device is essentially characterized in that, with the housing being formed by several parts assembled to one another, it comprises a guide body molded in plastic for guiding the rod, provided with a through hole which is traversed by said rod and with at least one side hole in communication with the through hole; and a receptacle, detachably plugged to the side hole of the guide body, which houses and guides the movement of the brake body towards the retaining rod through the mentioned side hole, and in which the compression spring is supported to exert its thrusting action on the brake body.

According to an embodiment of the invention, the receptacle is formed by a tubular body closed at one of its ends and with a circular inner cross-section, formed from a single part and molded in plastic, and the side hole of the guide body and the mouth of the mentioned receptacle are provided with respective means for their mutual bayonet coupling.

According to an embodiment of this variant, in the vicinity of its mouth the receptacle is provided with outwardly oriented transverse tabs, while the side hole of the guide body is provided with an annular channel provided with coupling portions arranged at least in a number equal to the number of tabs, each coupling portion being provided with an access opening suitable for introducing and/or extracting the tabs from the annular channel, and with a retaining portion suitable for retaining the tab inside the annular channel by the effect of the thrust exerted by the compression spring on the bottom of the receptacle, all of this such that the passage of the tabs from the access portion to the retaining portion, or vice versa, is performed by the rotation of the receptacle in relation to the guide body.

According to another feature, the outer surface of the receptacle is provided with a series of longitudinal reinforcement ribs extending from the transverse tabs towards the opposite end of the receptacle.

Furthermore, it is envisaged that the closed end of the receptacle is provided with means for the coupling under pressure of a protective cover of the device.

According to a variant of interest, in a symmetrical manner in relation to the retaining rod, the guide body comprises a second side hole, in communication with its through hole, in which there is plugged a corresponding second receptacle which guides the movement of a second brake body towards the mentioned retaining rod, which receives the support of the two brake bodies of the device, and in which a corresponding second compression spring is supported to exert its thrusting action on the mentioned second brake body.

In relation to this variant it must be mentioned that the guide body positions the receptacles and assures that the two brake bodies are axially aligned in contrast to what occurs with the devices based on two semi-housings, in which the tolerances between the mutual fixing area and the area over which the brake bodies slide can cause a certain misalignment, being able to cause noises, torque losses and low stability in a defined rest position. In addition, the fixing plane determined by the outer face of the fixing plate is assured as it is integrally formed in one and the same part, in this case in the guide body.

Preferably, the two receptacles according to this last variant of interest are identical.

According to another feature of the invention, the guide body is provided with a support plate in which there are embedded metal components for the firm fixing of the mentioned guide body, and at least one of the receptacles extends on the support plate covering at least one of the mentioned metal components.

In an embodiment variant, the metal components are formed by nuts the respective through holes of which lead to the exterior on both sides of the support plate.

Advantageously, the configuration of the device allows components for the fixing of the guide body to be overinjected in the guide body without needing to locate them moved to a side of the cavity in which the brake means are housed, and furthermore being able to fix the latter on the two sides of the mold from which the guide body is formed, the cycle time for obtaining the part thus being reduced. This fixing is possible due to the fact that both sides of the fixing plate are accessible during the manufacture of the guide body. When this is not so, it is necessary to fix the components by screwing by means of a suitable tool during the operation of overmolding, and subsequently unscrewing the tool, for which reason the cycle time is longer.

The bayonet system furthermore allows disassembling the receptacles without damaging any component, which allows substituting the compression springs for example.

BRIEF DESCRIPTION OF THE DRAWINGS

The attached drawings illustrate the components and a device according to an embodiment of the invention. In said drawings.

DETAILED DESCRIPTION OF THE DRAWINGS

Figure 4:
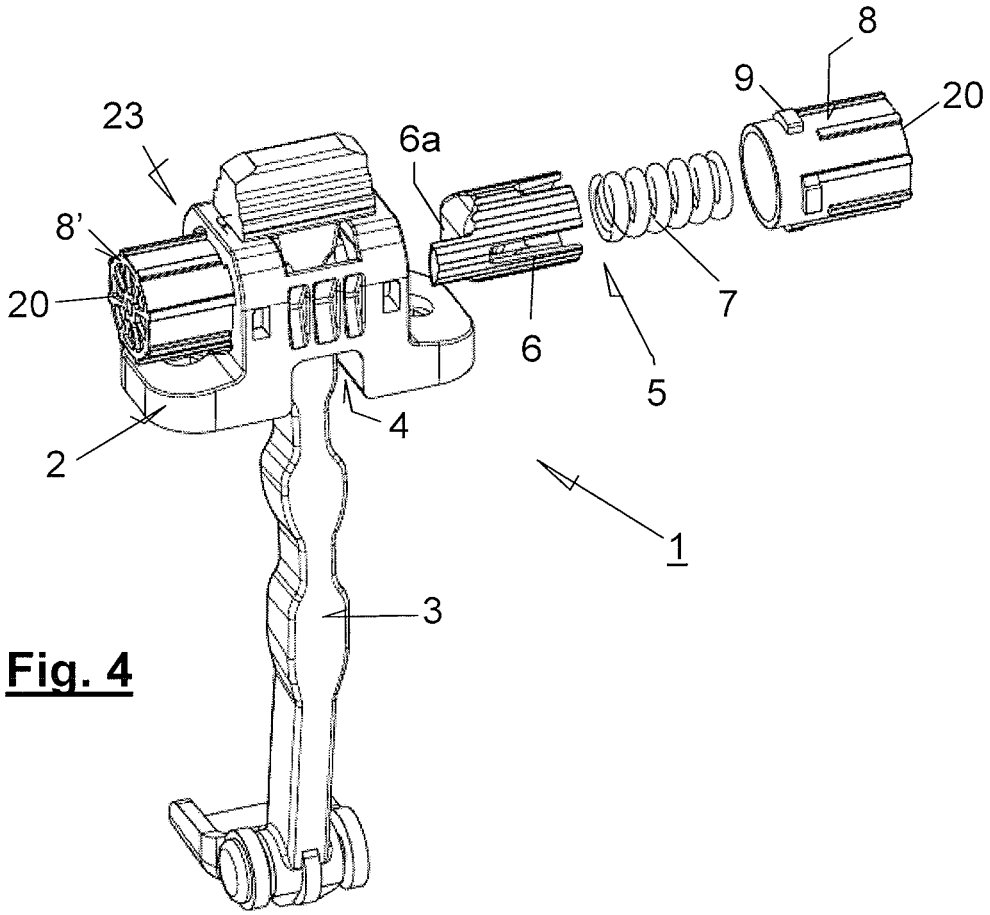
FIG. 4 is a view of the device according to the invention, in which some of its components have been depicted in a correlative fitting position.

The device 1 depicted in FIG. 4 comprises in a known manner a retaining rod 3, intended to be attached rotatably and at one of its ends to the frame of a door of an automotive vehicle; a housing 23 provided with means for its firm fixing to the mentioned door and guiding the movement of the rod 3 during the operations of opening and closing of the door; and brake means 5, housed in the housing 23, which exert a resistance to the longitudinal movement of the rod 3 in relation to the mentioned housing 23.

The housing 23 of the variant of the device 1 according to the invention depicted in FIG. 4 is formed by three parts: a guide body 2 and two identical receptacles 8 and 8', of a single part, suitable for being assembled to the guide body 2, all of this as is described below.

Figure 1:
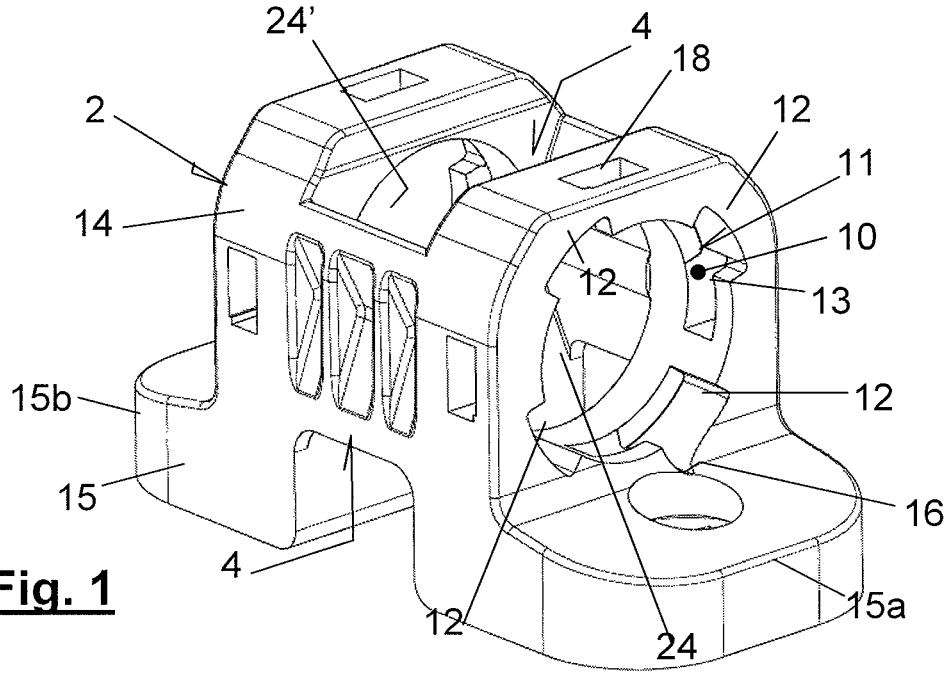
FIG. 1 is a perspective view of a first variant for a guide body.

A variant of the guide body 2 is shown in FIG. 1, which depicts a guide body 2 formed by a single part molded in plastic and provided with a through hole 4, with a rectangular cross section and intended to guide the retaining rod, and with two side holes 24 and 24' connecting the outside of the guide body 2 with the through hole 4. In the depicted example, the side holes 24 and 24' are axially aligned and are perpendicular to the direction followed by the through hole 4.

The guide body 2 is provided with two diametrically opposite flanges 15*a* and 15*b*, each of which extends on a side of the through hole 4, which determine a support plate 15 for the stable support of the guide body 2 on a planar surface of the door of the vehicle and in which respective metal components 16 for the fixing of the guide body 2 are embedded.

In the example of the drawings, a respective nut is embedded inside each of the flanges 15*a* and 15*b*, and it can be observed that said nuts are aligned and are arranged immediately below the receptacles 8 and 8' once the latter are duly coupled to the guide body 2. Since the guide body 2 lacks parts for housing the brake means, the mentioned metal components 16 are accessible and can be secured without difficulty on both sides of the support plate 15 during the manufacture of the guide body 2, being completely locked without needing to use a threaded tool to prevent the movement thereof in the axial direction during the overmolding of said components. Although it is not depicted, it is envisaged that in an alternative variant the metal components 16 are formed by screws or equivalent elements overmolded during the manufacture of the guide body 2.

Figure 3:
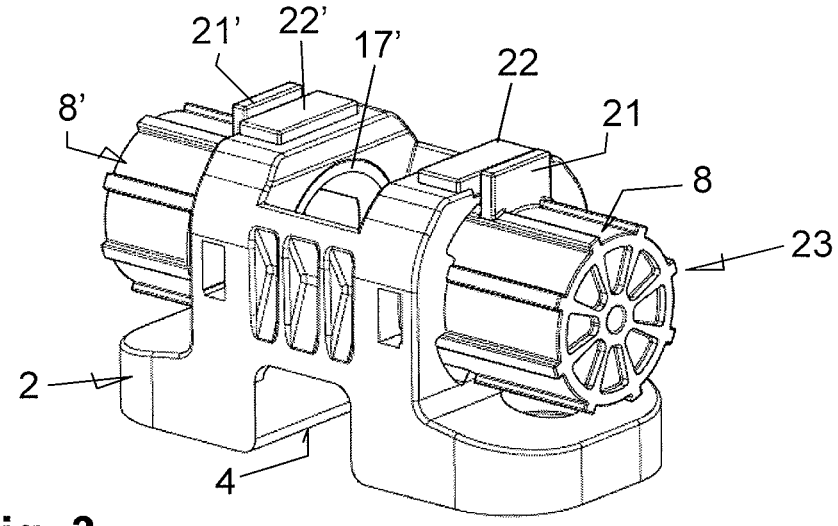
FIG. 3 is a perspective view of a second variant of a guide body in which two receptacles such as those depicted in FIG. 2 are duly coupled.

In FIG. 1 it can be observed that each of the side holes 24, 24' of the guide body 2 is prepared to receive the bayonet coupling of a corresponding receptacle 8 and 8', as has been depicted in FIG. 3. To that end, each side hole 24, 24' is provided with an annular channel 10 provided with four coupling portions 11, each of which is in turn provided with an access opening 12 and with a retaining portion 13, suitable for allowing the insertion and the retention, respectively, in said channel 10 of tabs 9 provided for such purpose in the vicinity of the mouth 17 of the receptacles 8 and 8', which can be reversibly or removably coupled to the guide body 2 upon rotating, after the tabs 9 have been introduced in the channel 10, towards the retaining portions 13.

It is observed in FIG. 1 that the guide body 2 has a series of access holes 18, through which the suitable tools can be introduced inside the mold of the part during its molding to occupy those spaces which will subsequently determine the annular channel 10.

Figure 2:
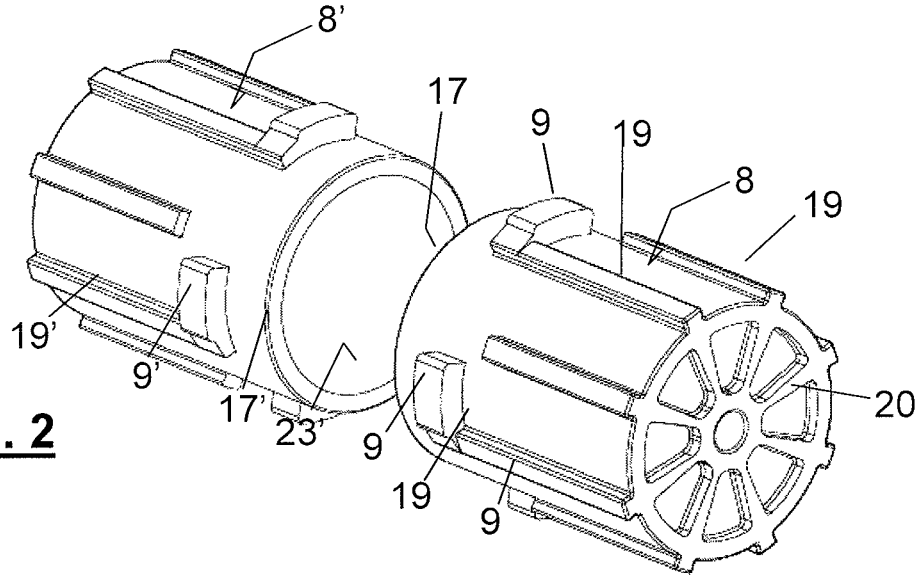
FIG. 2 is a perspective view of a set of receptacles suitable for their bayonet coupling in the guide body of FIG. 1.

FIG. 2 shows an embodiment variant of two receptacles 8, 8' intended to be plugged in the side holes 24, 24' of the guide body 2 of FIG. 1.

For their bayonet coupling with the mentioned guide body 2 the receptacles 8, 8' are provided, in the vicinity of their mouth 17, with the outwardly oriented transverse tabs 9, which are introduced in the retaining portions 13 of the annular channel 10 of the side holes 24, 24' of the guide body 2.

The depicted receptacles 8, 8' are provided in their outer surface with a series of longitudinal reinforcement ribs 19 extending from the transverse tabs 9 towards the opposite end of each receptacle. It is furthermore observed that the closed end 20 of the receptacles 8, 8' is provided with means for the coupling under pressure of a protective cover of the device 1.

In the variant of FIG. 3, the receptacles 8, 8' are furthermore provided with a respective upper flange 21, intended to prevent the forced movement of stop means 22, formed by respective bodies of rubber or the like, occasionally placed in the mouth of the through hole 4 of the guide body 2 to prevent the direct contact between the terminal of the retaining rod 3 and the guide body in the maximum opening position of the door of the vehicle, a situation is depicted in FIG. 4.

The receptacles 8, 8' are formed by tubular bodies closed at one of their ends and they preferably have a circular inner cross-section to allow the free rotation of the brake body 6 housed therein. FIG. 4 depicts the receptacle 8 in a fitted position, leaving exposed the components of the brake means 5 housed therein, formed in a known manner by the mentioned brake body 6 and a respective compression spring 7 which, supported against the closed end 20 of the receptacle 8, exerts a thrusting force on said brake body 6 towards the retaining rod 3.

The assembly of the device 1 is very simple in practice, since it does not require complementary elements for the mutual fixing of the parts forming the housing 23. Furthermore, since the guide body 2 lacks not provided with parts intended to guide or contain the brake means, the manufacture thereof is facilitated and fixing means can be overinjected which, once the housing 23 is assembled, are arranged in the same plane of movement of the brake bodies and normal to the support surface of the guide body.

Figure 5:
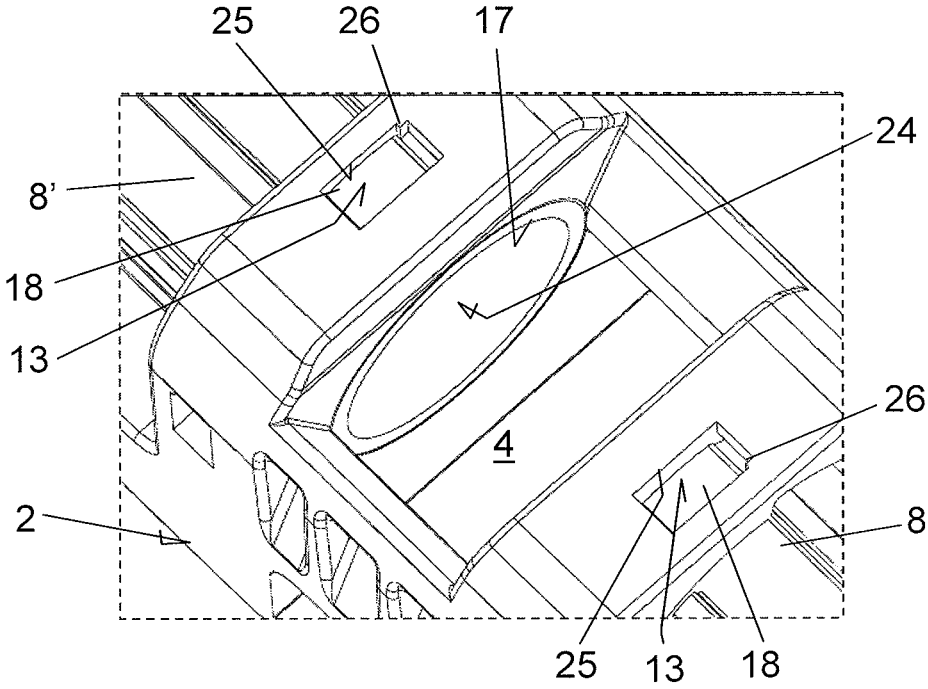
FIG. 5 is a detail of the retaining portions of the annular channels with which the guide body of FIG. 1 is provided.

It should be stated that during the assembly of the housing 23, when the receptacles 8, 8' rotate, the tabs 9 being shifted until reaching the retaining portions 13 of the corresponding annular channel 10, the thrusting force itself exerted by the compression spring 7 upon attempting to expand assures that the tabs 9 do not accidentally slide towards the access openings 12 of the annular channel 10. The compression spring 7 applies under pressure the tabs 9 against the outer wall 25 of the channel 10 in its retaining portions 13, which can be provided with safety or anti-return means for preventing the rotation of the receptacles 8, 8' in the direction opposite that of their coupling. By way of example, it is envisaged to provide the mentioned outer wall with a certain inclination, each retaining portion 13 of the channel 10 being widened in the coupling direction of the receptacles 8, 8', or provide the mentioned retaining portions with a width greater than that of the height of the tabs 9, providing in turn the outer wall 25 of the channel 10, in at least one section of access to a retaining portion 13, with a rib or protuberance 26 (see FIG. 5) which acts like a stop, preventing the rotation of the receptacles 8, 8' in the direction opposite that of their coupling if the thrusting force exerted thereon by the associated compression spring is not previously overcome.

The invention claimed is:

1. A door retaining device comprising:

a housing and a retaining rod which traverses the housing, the housing configured to be firmly fixed to one of a door of a vehicle and a framework of said door, while the rod is configured to be pivotably fixed to the other of the door of the vehicle and the framework of said door, the device furthermore comprising a brake mechanism, housed in the housing which comprises at least one brake body stressed by a corresponding compression spring towards the retaining rod to exert by friction a resistance to longitudinal movement of the rod in relation to the housing, the housing formed by several parts assembled to one another, comprising a guide body molded in plastic for guiding the rod, provided with a through hole which is traversed by said rod and with at least one side hole in communication with the through hole; and a receptacle, detachably plugged to the side hole of the guide body, which houses and guides the movement of the brake body towards the retaining rod through the side hole, and in which the compression spring is supported to exert thrusting action on the brake body.

2. The device according to claim 1, wherein the receptacle is formed by a tubular body closed at one end and with a circular inner cross section, formed from a single part and molded in plastic, and the side hole of the guide body and a mouth of the receptacle are provided with respective mechanisms for mutual bayonet coupling.

3. The device according to claim 2, wherein the vicinity of the mouth the receptacle is provided with outwardly oriented transverse tabs, while the side hole of the guide body is provided with an annular channel provided with coupling portions arranged at least in a number equal to the number of tabs, each coupling portion provided with an access opening suitable for introducing or extracting the tabs from the annular channel, and with a retaining portion suitable for retaining the tab inside the annular channel by the effect of the thrust exerted by the compression spring on the bottom of the receptacle, such that the passage of the tabs from the access opening to the retaining portion or from the retaining portion to the access opening is performed by the rotation of the receptacle in relation to the guide body.

4. The device according to claim 3, wherein an outer surface of the receptacle is provided with a series of longitudinal reinforcement ribs extending from the transverse tabs towards the opposite end of the receptacle.

5. The device according to claim 1, wherein a closed end of the receptacle is provided with means for the coupling under pressure of a protective cover of the device.

6. The device according to claim 1, wherein in a symmetrical manner in relation to the retaining rod, the guide body comprises a second side hole, in communication with the through hole, in which there is plugged a corresponding second receptacle which guides the movement of a second brake body towards the retaining rod, which receives the support of the two brake bodies of the device, and in which a corresponding second compression spring is supported to exert its thrusting action on the second brake body.

7. The device according to claim 6, wherein the two receptacles are identical.

8. The device according to claim 1, wherein the guide body is provided with a support plate in which there are embedded metal components for firmly fixing the guide body, and the receptacle extends on the support plate covering at least one of the metal components.

9. The device according to claim 8, wherein the metal components are formed by nuts the respective through holes of which lead to an exterior on both sides of the support plate.

10. The device according to claim 1, wherein the receptacle comprises a tubular body with a mouth, the side hole of the guide body and the mouth of the receptacle-are provided with respective couplings for securing the receptacle to the guide body.

11. The device according to claim 10, wherein the receptacle is closed at one end.

12. The device according to claim 10, wherein the receptacle comprises a circular inner cross section.

13. The device according to claim 10, wherein the receptacle is a one-piece integral construction.

14. The device according to claim 1, further comprising a second receptacle that houses and guides movement of a second brake body towards the retaining rod and in which a second compression spring is supported.

15. The device according to claim 1, wherein the retaining rod is configured to be pivotably fixed to the other of the door of the vehicle and the framework of said door at a first end of the retaining rod, the retaining rod comprises a projection at a second end of the retaining rod opposite to the first end of the retaining rod, the projection extending in a direction transverse to a longitudinal direction of the retaining rod; wherein the guide body comprises a first surface defining a first opening and a second surface defining a second opening, the first opening and the second opening aligned with the through hole, the through hole extending from the first opening to the second opening; and wherein the projection is configured to abut against the first surface to limit movement of the rod in the through hole.

16. The device according to claim 15, wherein, when the receptacle is plugged in the side hole of the guide body, the guide body extends around an entire periphery of at least a portion of the receptacle.

17. The device according to claim 15, wherein the guide body is an integral one-piece construction.

* * * * *